US006488011B1

(12) United States Patent
Frank et al.

(10) Patent No.: US 6,488,011 B1
(45) Date of Patent: Dec. 3, 2002

(54) HIGH-PRESSURE FUEL RESERVOIR

(75) Inventors: Kurt Frank, Schorndorf (DE); Steffen Jung, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/806,763

(22) PCT Filed: Aug. 1, 2000

(86) PCT No.: PCT/DE00/02531

§ 371 (c)(1),
(2), (4) Date: Jul. 27, 2001

(87) PCT Pub. No.: WO01/09507

PCT Pub. Date: Feb. 8, 2001

(30) Foreign Application Priority Data

Aug. 3, 1999 (DE) ..... 199 36 533

(51) Int. Cl.[7] ..... F02M 41/00
(52) U.S. Cl. ..... 123/456; 123/447; 123/468
(58) Field of Search ..... 123/456, 457, 123/468, 469, 447

(56) References Cited

U.S. PATENT DOCUMENTS

| | | | | | |
|---|---|---|---|---|---|
| 5,603,302 | A | * | 2/1997 | Minagawa et al. | 123/456 |
| 5,752,486 | A | * | 5/1998 | Nakashima et al. | 123/447 |
| 5,803,051 | A | * | 9/1998 | Stehr | 123/456 |
| 5,845,621 | A | * | 12/1998 | Robinson et al. | 123/456 |
| 6,227,169 | B1 | * | 5/2001 | Sato et al. | 123/456 |
| 6,237,569 | B1 | * | 5/2001 | Stelzer et al. | 123/456 |
| 6,321,719 | B1 | * | 11/2001 | Schwegler | 123/456 |
| 6,405,712 | B1 | * | 6/2002 | Nomura | 123/41.31 |

* cited by examiner

*Primary Examiner*—Tony M. Argenbright
*Assistant Examiner*—Hai H. Huynh
(74) *Attorney, Agent, or Firm*—Ronald E. Greigg

(57) ABSTRACT

The invention relates to a high-pressure fuel reservoir for a common rail fuel injection system of an internal combustion engine, with a tubular base body which has a blind bore extending in the longitudinal direction and a number of connections. In order to improve the high-pressure-tightness and the service life of the high-pressure fuel reservoir, a stopper is disposed in the closed end of the blind bore.

13 Claims, 1 Drawing Sheet

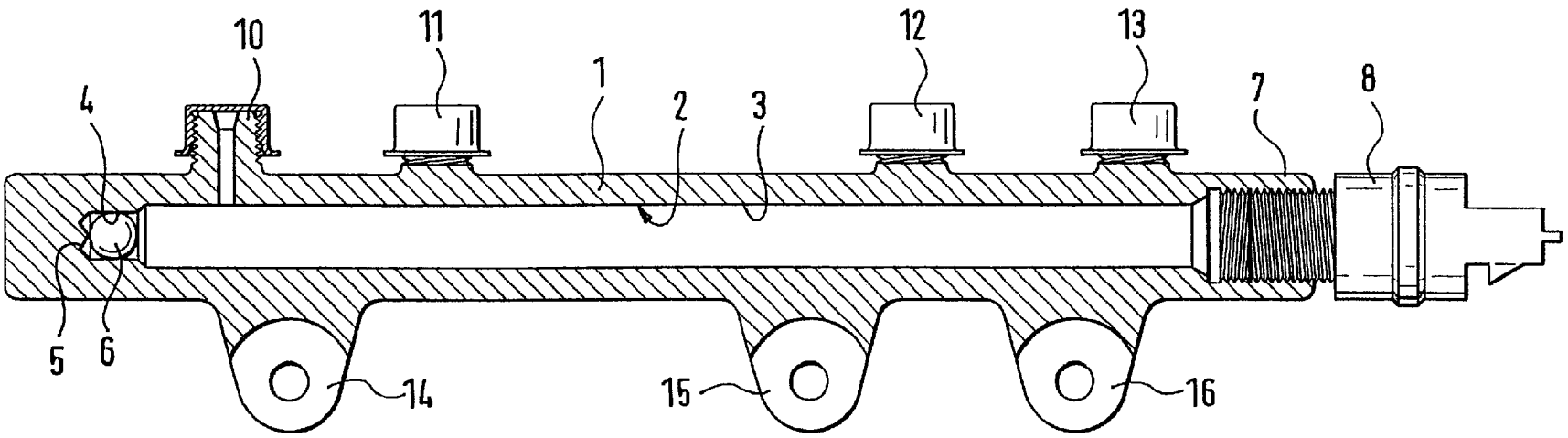
8
7
13
12
3
2
1
11
10
4
6
5
16
15
14

HIGH-PRESSURE FUEL RESERVOIR

CROSS-REFERENCE TO RELATED APPLICATIONS

This application is a 35 USC 371 application of PCT/DE 00/02531 filed on Aug. 1, 2000.

BACKGROUND OF THE INVENTION

1. Field of the Invention

The invention relates to a high-pressure fuel reservoir for a common rail fuel injection system of an internal combustion engine, with a tubular base body which has a blind bore extending in the longitudinal direction and a number of connections.

2. Description of the Prior Art

A high-pressure fuel reservoir of the type with which this invention is concerned is described, for example, in DE 195 48 611. In common rail injection systems, a high-pressure pump, possibly with the aid of a presupply pump, supplies the fuel to be injected from a tank to the central high-pressure fuel reservoir, which is referred to as the common rail. Fuel lines lead from the rail to the individual injectors which are associated with the cylinders of an internal combustion engine. The injectors are individually triggered by the engine electronics as a function of the operating parameters of the engine in order to inject fuel into a combustion chamber of the engine. The pressure production and the injection are decoupled from each other by the high-pressure fuel reservoir. During operation, very high pressures are produced in the high-pressure fuel reservoir, which is why very high demands are placed on the high-pressure-tightness of the high-pressure fuel reservoir.

The object of the invention is to embody a high-pressure fuel reservoir of the type described above so that the high-pressure-tightness is improved and the service life is extended. In addition, the high-pressure fuel reservoir according to the invention should be simple in design and inexpensive to manufacture.

SUMMARY OF THE INVENTION

In a high-pressure fuel reservoir for a common rail fuel injection system of an internal combustion engine, with a tubular base body which has a blind bore extending in the longitudinal direction and a number of connections, the above object is attained by a stopper or plug being disposed in the closed end of the blind bore. The stopper serves to seal off the geometry at the closed end of the blind bore, which geometry is produced by the drilling tool and is unfavorable with regard to high-pressure-tightness, from the section of the blind bore that is used to contain the fuel. This offers the advantage that the geometry at the closed end of the blind bore which is unfavorable with regard to high-pressure-tightness does not have to be mechanically finished. In addition, the stopper also offers flow engineering advantages which become apparent during operation of the high-pressure fuel reservoir.

One particular embodiment of the invention is characterized in that the blind bore has a smaller diameter at its closed end than in the section of the blind bore used to contain the fuel. Predrilling with a narrower drill diameter and then redrilling the blind bore with a greater diameter improves the surface quality of the blind bore. In addition, tool wear is minimized during production of a bore of this kind that is stepped at its closed end.

Another particular embodiment of the invention is characterized in that the stopper is spherical. With regard to its sealing action, the stopper can also be the shape of a circular cylinder, among others. When the stopper is inserted, though, the stopper can rotate or tilt in the blind bore. The spherical shape facilitates the insertion of the sphere, particularly in the case of a stepped blind bore.

Another particular embodiment of the invention is characterized in that the stopper is press-fitted into the closed end of the blind bore. It is also possible to fix the stopper, e.g. with the aid of a thread or a separate fixing device, in the closed end of the blind bore. Press-fitting offers the advantage over other methods that no additional separate parts are required and the manufacturing cost is low.

Another particular embodiment of the invention is characterized in that the open end of the blind bore is closed by means of a pressure sensor. This offers the advantage that no additional high-pressure seal is required for the pressure sensor. A stopper is no longer required for the open end of the blind bore.

BRIEF DESCRIPTION OF THE DRAWINGS

Other advantages, features, and details of the invention ensue from the following description in which an exemplary embodiment of the invention will be described in detail in conjunction with the single figure of the drawing which is a longitudinal section through a high-pressure fuel reservoir according to the invention.

DESCRIPTION OF THE PREFERRED EMBODIMENT

The high-pressure fuel reservoir shown in the drawing is comprised of a tubular base body 1. A blind bore 2 extends in the axial direction in the tubular base body 1. The blind bore 2 has a section 3 with a larger diameter and a section 4 with a smaller diameter. The double point 5 of a long drill bit is shown at the closed end of section 4 of the blind bore 2. The annular recess that this drill bit produces in the bottom of the bore is unfavorable from a flow engineering standpoint and in terms of high-pressure-tightness. The geometry produced by a normal 120° drill bit does in fact demonstrate better behavior, but taken as a whole, is likewise unfavorable. As a rule, therefore, the bottom of the bore must be finished, e.g. by being rounded.

According to the current invention, a sealing ball 6 is press-fitted in a sealed fashion into the section 4 of the blind bore 2. The sealing ball 6 blocks off the end region of the blind bore 2 that is unfavorable with regard to high-pressure-tightness. As a result, no mechanical finishing in the form of rounding is required in this critical area. In spite of this fact, the high-pressure fuel reservoir according to the invention achieves a very favorable high-pressure-tightness.

A pressure sensor 8 is inserted in a high-pressure-tight manner into the open end 7 of the blind bore 2. This limits the number of high-pressure seals. As a rule, the high-pressure seal points are critical with regard to their tightness and require a high machining cost since the surface and the geometry of the high-pressure sealing points must meet strict requirements. In comparison to a high-pressure fuel reservoir with a through bore that is sealed by two stoppers, embodying the high-pressure fuel reservoir as a blind bore eliminates one high-pressure sealing point.

In addition, connections 10, 11, 12, and 13 for high-pressure fuel lines are embodied on the tubular base body 1 of the high-pressure fuel reservoir according to the invention. The high-pressure fuel lines produce a connection between the high-pressure fuel reservoir and a high-pressure fuel pump (not shown) and injectors (not shown).

Furthermore, three fastening elements 14, 15, and 16 are embodied on the tubular base body 1. The fastening elements 14, 15, and 16 are used for installing the high-pressure fuel reservoir in the internal combustion engine.

The foregoing relates to preferred exemplary embodiment of the invention, it being understood that other variants and embodiments thereof are possible, within the spirit and scope of the invention, the latter being defined by the appended claims.

We claim:

1. A high-pressure fuel reservoir for a common rail fuel injection system of an internal combustion engine, comprising a tubular base body (1) having a blind bore (2) extending in the longitudinal direction and a number of connections (10 to 13), and a stopper (6) disposed in the closed end of the blind bore (2).

2. The high-pressure fuel reservoir according to claim 1, wherein the blind bore (2) has a smaller diameter at its closed end (4) than in the section (3) of the blind bore (2) used to contain the fuel.

3. The high-pressure fuel reservoir according to claim 2, wherein the stopper (6) is spherical.

4. The high-pressure fuel reservoir according to claim 3, wherein the open end (7) of the blind bore (2) is closed by a pressure sensor (8).

5. The high-pressure fuel reservoir according to claim 2, wherein the stopper (6) is press-fitted into the closed end (4) of the blind bore (2).

6. The high-pressure fuel reservoir according to claim 5, wherein the open end (7) of the blind bore (2) is closed by a pressure sensor (8).

7. The high-pressure fuel reservoir according to claim 2, wherein the open end (7) of the blind bore (2) is closed by a pressure sensor (8).

8. The high-pressure fuel reservoir according to claim 1, wherein the stopper (6) is spherical.

9. The high-pressure fuel reservoir according to claim 8, wherein the stopper (6) is press-fitted into the closed end (4) of the blind bore (2).

10. The high-pressure fuel reservoir according to claim 8, wherein the open end (7) of the blind bore (2) is closed by a pressure sensor (8).

11. The high-pressure fuel reservoir according to claim 1, wherein the stopper (6) is press-fitted into the closed end (4) of the blind bore (2).

12. The high-pressure fuel reservoir according to claim 11, wherein the open end (7) of the blind bore (2) is closed by a pressure sensor (8).

13. The high-pressure fuel reservoir according to claim 1, wherein the open end (7) of the blind bore (2) is closed by a pressure sensor (8).

* * * * *